US005320207A

United States Patent [19]

Abe

[11] Patent Number: 5,320,207

[45] Date of Patent: Jun. 14, 1994

[54] COIN THROWING PORT RESTRICTING MECHANISM AND COIN THROWING DEVICE

[75] Inventor: Hiroshi Abe, Tokyo, Japan

[73] Assignee: Asahi Seiko Kabushiki Kaisha, Tokyo, Japan

[21] Appl. No.: 953,725

[22] Filed: Sep. 29, 1992

[30] Foreign Application Priority Data

Oct. 1, 1991 [JP] Japan ..... 3-100518[U]
Sep. 22, 1992 [JP] Japan ..... 4-076209[U]

[51] Int. Cl.[5] ..... G07D 5/02
[52] U.S. Cl. ..... 194/335; 194/338
[58] Field of Search ..... 194/212, 214, 334, 335, 194/338, 344

[56] References Cited

U.S. PATENT DOCUMENTS 1,995,493 3/1935 Ardiff ..... 194/214
2,008,416 7/1935 Goetz ..... 194/214
2,177,689 10/1939 Dalkin ..... 194/212

FOREIGN PATENT DOCUMENTS 1944487 3/1971 Fed. Rep. of Germany ..... 194/212

*Primary Examiner*—F. J. Bartuska
*Attorney, Agent, or Firm*—Hopgood, Calimafde, Kalil, Blaustein & Judlowe

[57] ABSTRACT

A coin throwing port restricting mechanism 10 enables substantial restriction of a configuration of a coin throwing port 4 by means of a simply handling thereof. Such a coin throwing port restricting mechanism 10 contributes to provide a coin throwing device which has only one coin throwing port 4 and which can receive many kinds of coins of different sizes. The coin throwing port restricting mechanism 10 comprises a ring 11 and an arm 12. The ring 11 which serves as a fixing member surrounds the coin throwing port 4. The arm 12 extends from the inner periphery of the ring 11 to the center thereof in a manner that it faces front to the coin throwing port 4. The extending length and the extending width of the arm 12 are selectable depending on the diameter and the thickness of the coin. Thus, the configuration of the coin throwing port 4 can be restricted without modifying the shape thereof.

8 Claims, 6 Drawing Sheets

COIN THROWING PORT RESTRICTING MECHANISM AND COIN THROWING DEVICE

BACKGROUND OF THE INVENTION

This invention relates to a mechanism for restricting a configuration of a coin throwing port depending on a size of a coin. More particularly, this invention relates to a coin throwing port restricting mechanism for use in a coin throwing device such as a vending machine, a coin exchanger and a coin operated gaming machine.

A coin throwing port of a coin throwing device is typically required to receive a money coin, a nominal or imitation coin such as a coin for the gaming machine or a token, a metal disc plate, a washer or the like used in a device activated by coins of various sizes. More particularly, such a device is required to receive coins having different diameter and thickness. However, preparation of plural kinds of coin throwing ports for receiving coins which are different in size is troublesome in that such a coin throwing device can only be manufactured and assembled with higher costs. Further, handling of each component thereof will be complicated. Accordingly, it is preferable to form only one coin throwing port for the coin throwing machine. Thus, a coin throwing port restricting mechanism has thus been desired which substantially restricts the configuration of the coin throwing port so that it matches to coins in various sizes.

For example, a conventional coin throwing port restricting mechanism comprises, as disclosed in Japanese Unexamined Utility Model Registration Prepublication No. 118,474/1982, a chute for guiding a coin transported from the coin throwing port to a coin sorting device. This chute comprises a pair of side plates. The side plates are opposed to each other and are movable along a longitudinal direction of the coin throwing port crossing over the coin throwing port. A longitudinal length of the coin throwing port is restricted by means of securing the pair of side plates at or near the coin throwing port to the size of each coin.

However, in the above mentioned conventional coin throwing port restricting mechanism, it is necessary to position each of the pair of side plates by independently moving one by one. Thus, complex and bothersome adjustment should be required for receiving many kinds of coins of different sizes. Further, the conventional coin throwing port restricting mechanism restricts only the longitudinal length of the coin throwing port and there is a problem that it provides no restriction for the thickness or width thereof.

Therefore, with respect to the above mentioned problems, a primary object of the present invention is to provide a coin throwing port restricting mechanism applicable for different coins of various sizes.

Another object of the present invention is to provide a coin throwing port restricting mechanism which enables substantial restriction of the configuration of the coin throwing port only by means of simply handling the coin throwing port restricting mechanism.

In addition, it is further object of the present invention to provide a coin throwing device having components which can be readily handled, manufactured and assembled with lower cost.

SUMMARY OF THE INVENTION

According to the present invention, in a coin throwing port restricting mechanism for use in a coin throwing device having a coin throwing wall consisting of a front surface and a back surface opposed to said front surface, and a coin throwing port which is opened on said coin throwing wall for receiving a coin and which has a predetermined throwing port length and a predetermined throwing port width, said coin throwing port restricting mechanism comprises a fixing member removably attached to said back surface and a restriction arm member extending from said fixing member facing front said coin throwing port, said restriction arm member is formed to partially cover said coin throwing port depending on the size of said coin in order to substantially restrict the configuration of said coin throwing port.

In addition, according to the present invention, in the above mentioned coin throwing port restricting mechanism, said coin has a predetermined diameter, and said restriction arm member has an extending length for partially covering said coin throwing port according to a difference between the diameter of said coin and said throwing port length to substantially restrict the throwing port length of said coin throwing port.

Further, according to the present invention, in the above mentioned coin throwing port restricting member, said restriction arm member comprises only one arm having said extending length.

Moreover, according to the present invention, in the aforementioned coin throwing port restricting mechanism, said extending length constitutes of a plurality of different extending lengths corresponding to a plurality of differences between one of a plurality of different coin diameters and said throwing port length, respectively, and said restriction arm member comprises a plurality of arms each of which has one of said plurality of extending lengths.

Furthermore, according to the present invention, in the coin throwing port restricting mechanism, said restriction arm member comprises a pair of arms, each of which has said extending length, said arms are opposed with each other at a distance corresponding to the diameter of said coin.

In addition, according to the present invention, in the coin throwing port restricting mechanism described above, said extending length constitutes of a plurality of different extending lengths corresponding to a plurality of differences between one of a plurality of different coin diameters and said throwing port length, respectively, and said restriction arm member comprises a plural pairs of arms having one of said plurality of extending lengths, said arms in each pair are opposed to each other at a distance corresponding to the different diameters of said coins.

Further, according to the present invention, in the coin throwing port restricting mechanism, said coin has a predetermined thickness, and said restriction arm member has an extending width for partially covering said coin throwing port according to a difference between the thickness of said coin and said throwing port width to substantially restrict the throwing port width of said coin throwing port.

Moreover, according to the present invention, in the above mentioned coin throwing port restricting mechanism, said restriction arm member comprises only one arm having said extending width.

In addition, according to the present invention, in the coin throwing port restricting mechanism, said extending width constitutes of a plurality of different extending widths corresponding to a plurality of differences between one of a plurality of different coin diameters and said throwing port width, respectively, and said restriction arm member comprises a plurality of arms each of which has one of said plurality of extending widths.

Further, according to the present invention, in the coin throwing port restricting mechanism, said coin has a predetermined diameter, and said restriction arm member comprises a pair of arms, said arms are opposed to each other at a distance corresponding to the diameter of said coin and have an extending width for partially covering said coin throwing port.

Still further, according to the present invention, in the aforementioned coin throwing port restricting mechanism, where said coin has different diameter, said restriction arm member comprises a plural pairs of arms, said arms in each pair are opposed to each other at a plurality of distances corresponding to the plurality of diameters of coins, respectively, and each of which has an extending width for partially covering said coin throwing port, and each of said plural pairs of arms has said extending width, respectively.

Furthermore, according to the present invention, in the coin throwing port restricting mechanism, each of said plural pairs of arms has different extending width.

Additionally, according to the present invention, in the coin throwing port restricting mechanism, each of said arms comprises a substantially U-shaped tip portion at a free end thereof, and said tip portions are opposed with each other at a distance corresponding to said extending width.

In addition, according to the present invention, in the coin throwing device having a coin throwing wall consisting of a front surface and a back surface opposed to said front surface, and a coin throwing port which is opened on said coin throwing wall and which has a predetermined throwing port longitudinal length and a predetermined throwing port width, said device comprises a fixing member removably attached to said back surface and a restriction arm member extending from said fixing member facing front said coin throwing port, said restriction arm member is formed to partially cover said coin throwing port depending on the size of said coin in order to substantially restrict the configuration of said coin throwing port, said device further comprises a guide member disposed on said back surface along the longitudinal direction of said coin throwing port, said guide member is for use in guiding said restriction arm member into said coin throwing port.

Further, according to the present invention, in the coin throwing device, said guide member comprises a pair of guide wall portions, said guide wall portions are opposed to each other and are for use in guiding said restriction arm member interposed therebetween to said coin throwing port.

In other words, the present invention is constructed by a coin throwing port disposed to a coin throwing device and a widely-used coin throwing port restricting mechanism for restricting the configuration of the coin throwing port depending on the shape of coins to be thrown.

More particularly, the present invention is characterized in that coin throwing port restricting mechanism where one or more restriction arm(s) is/are projected for substantially restricting the configuration of said coin throwing port by means of facing-front the coin throwing port is removably attached to the back surface of the slit-like coin throwing port opened on the front surface of the coin throwing device.

In a coin throwing port restricting mechanism according to the present invention, the arm of the restriction arm member extends from the fixing member attached to the back surface of the coin throwing device to partially cover the coin throwing port. In addition, the size or dimension (i.e., the extending length and the extending width) of the arm is selectable depending on the diameter and the thickness of a coin to be thrown. Therefore, the configuration of the coin throwing port can be substantially restricted without modifying or varying the shape of the port itself.

These and other objects and advantageous of this invention will become more readily apparent from the following detailed description of a preferred embodiment thereof when taken in conjunction with the accompanying drawings, in which:

BRIEF DESCRIPTION OF THE DRAWING

FIG. 8 is a partially perspective view of a coin throwing port assembly disposed on a front surface of a vending machine or the like;

DETAILED DESCRIPTION OF THE PREFERRED EMBODIMENTS

Figure 1:
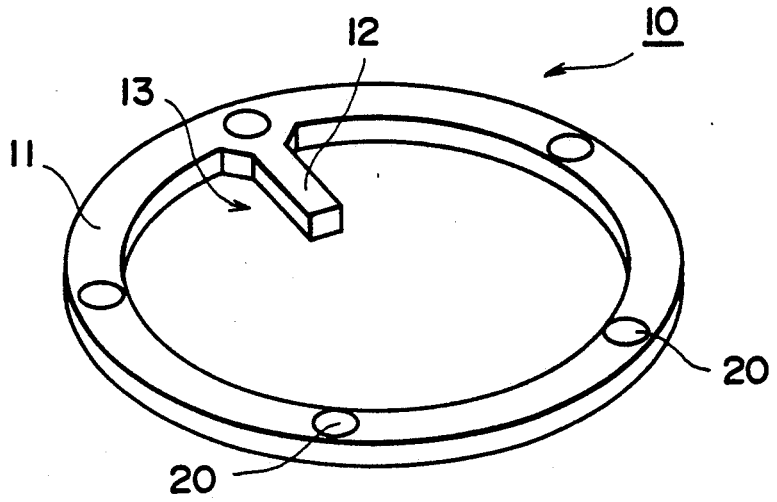
FIG. 1 is a perspective view of a coin throwing port restricting mechanism according to a first embodiment of the present invention.

Next, description will be made regarding to an embodiment of the present invention with reference to the drawing.

Figure 8:
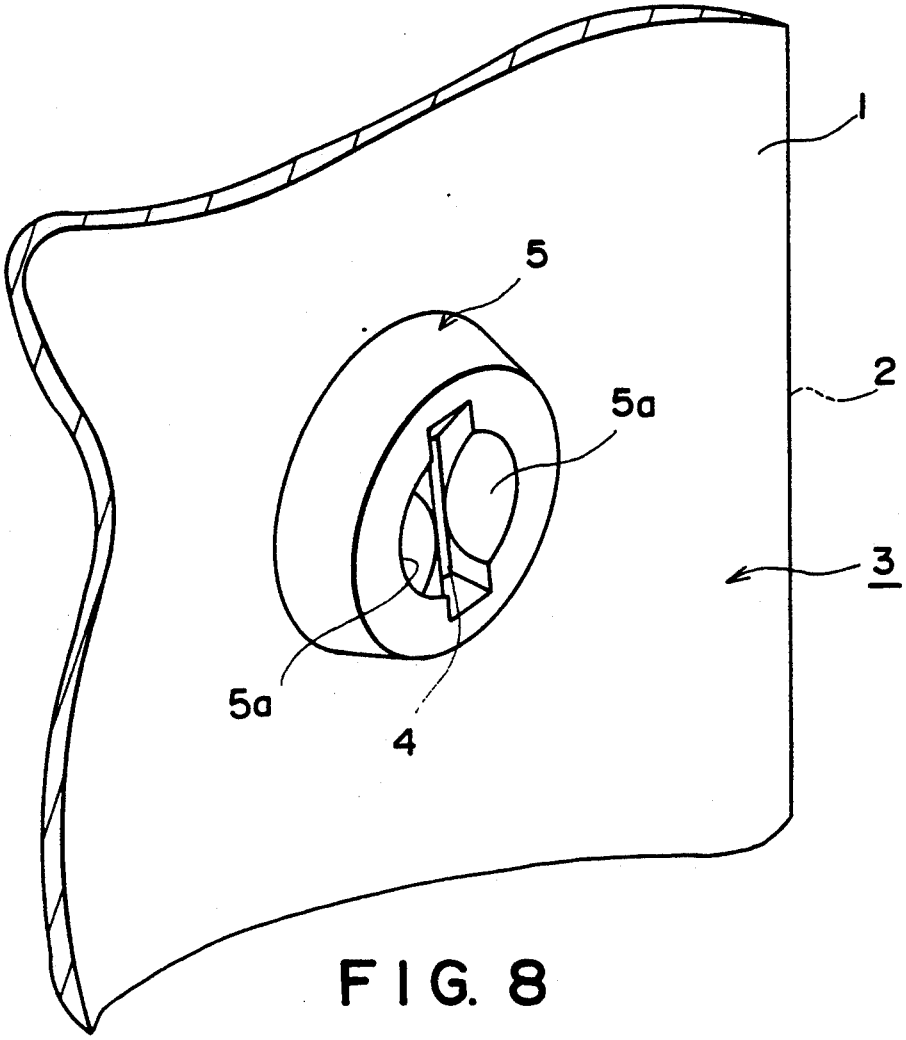
Figure 9:
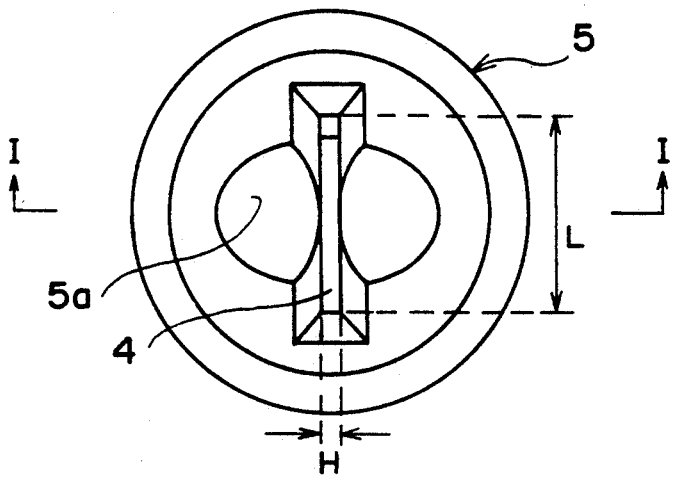
FIG. 9 is a front view of the coin throwing port assembly illustrated in FIG. 8.

First, as illustrated in FIGS. 8 and 9, a vending machine where a coin throwing port restricting mechanism according to the present invention is applied comprises a coin throwing wall 3 having a front surface 1 and a back surface 2. The vending machine also comprises a coin throwing port 4 opened on the coin throwing wall 3 as a slit where a coin (not shown) is thrown. The coin throwing port 4 has a throwing port length L and a throwing port width H.

In order to make it ease to push a coin into the coin throwing port 4, a coin throwing port assembly 5 is disposed on the front surface 1. The coin throwing port assembly 5 comprises a pair of concave portions 5*a*, 5*a* inclined towards the coin throwing port 4. A pair of concave portions 5a, 5a is formed as a vertically-split rugby ball. A coin picked up with fingers are correctly guided into a coin throwing port 4 along a pair of concave portions 5a, 5a.

Figure 10:
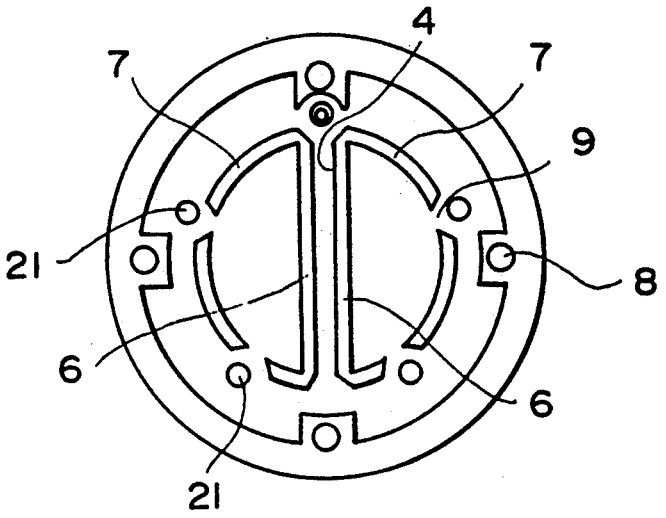
FIG. 10 is a rear view of the coin throwing port assembly illustrated in FIG. 8.
Figure 11:
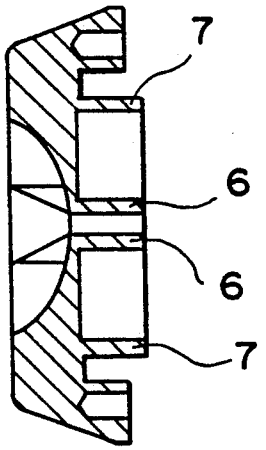
FIG. 11 is a vertical sectional view of the coin throwing port assembly illustrated in FIG. 8.

As illustrated in FIGS. 10 and 11, on the back surface 2 of the coin throwing port assembly 5 of the vending machine, a pair of guide wall portions 6, 6 is disposed in the longitudinal direction of the coin throwing port 4. The guide wall portions 6, 6 are opposed to each other and allow to position a restriction arm member 12 interposed therebetween into the coin throwing port 4. The guide wall portions 6, 6 are also used for sorting the thrown coins in accordance with its thickness and diameter.

Figure 2:
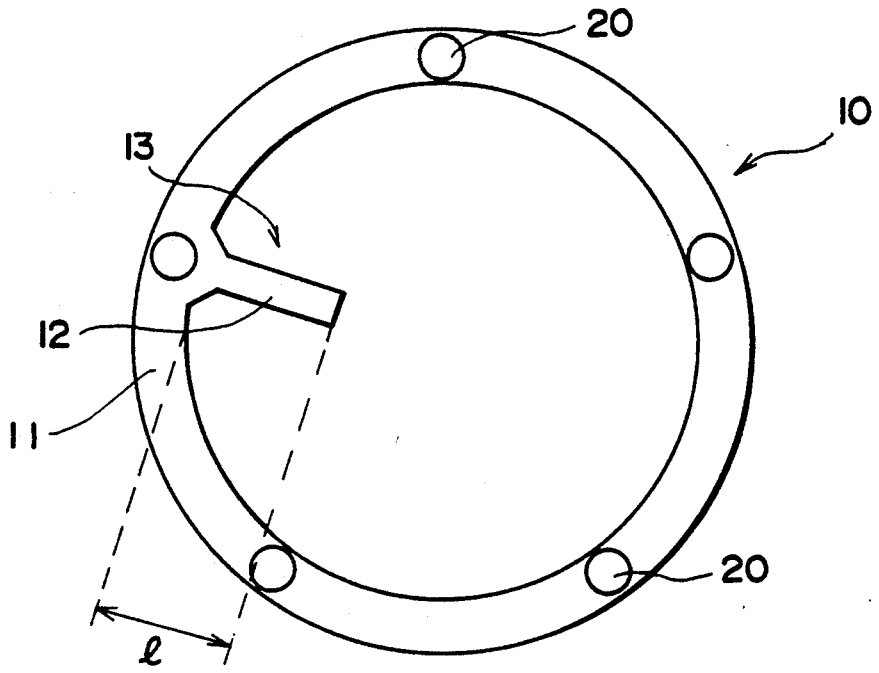
FIG. 2 is a front view of the coin throwing port restricting mechanism illustrated in FIG. 1.

FIGS. 1 and 2 illustrate a coin throwing port restricting mechanism 10 applied for the above mentioned coin throwing port assembly 5 of a vending machine. The coin throwing port restricting mechanism 10 is removably arranged on the back surface 2 of the coin throwing port assembly 5. The coin throwing port restricting mechanism 10 comprises a ring 11 constituting a fixing member for surrounding the coin throwing port 4 and a restriction arm member 13 comprising an arm 12. The restriction arm member 13 extends from an inner circumference of the ring 11 to the center of the ring 11. It faces front to the coin throwing port 4.

Assuming the diameter of the coin to be d, the arm 12 has an extending length l which covers the coin throwing port 4. The extending length l corresponds to a difference between the coin diameter d and the throwing port length L, namely, (L-d=l). As a result, the throwing port length L of the coin throwing port 4 can be substantially restricted.

The ring 11 may be formed as a polygon or a rectangle. In addition, in the above mentioned coin throwing port restricting mechanism 10, the restriction arm members 13 are disposed, equally apart from each other, along the circumference of the ring 11. However, it is apparent that the present invention should not be restricted thereto.

Figure 3:
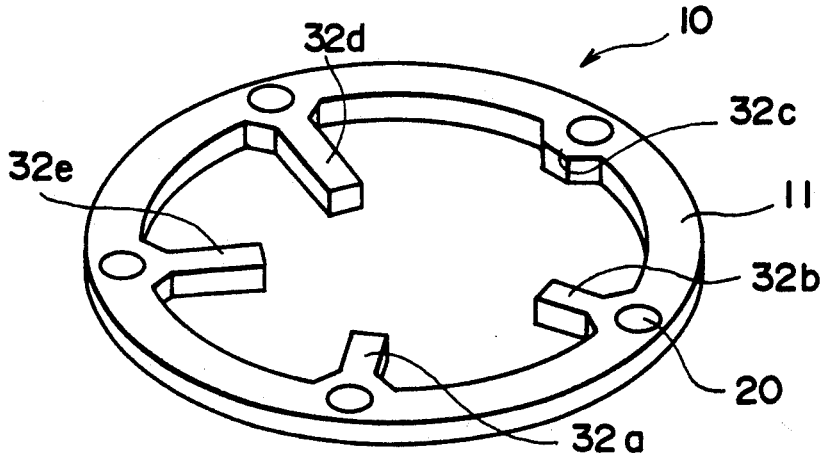
FIG. 3 is a perspective view of a coin throwing port restricting mechanism according to a second embodiment of the present invention.
Figure 4:
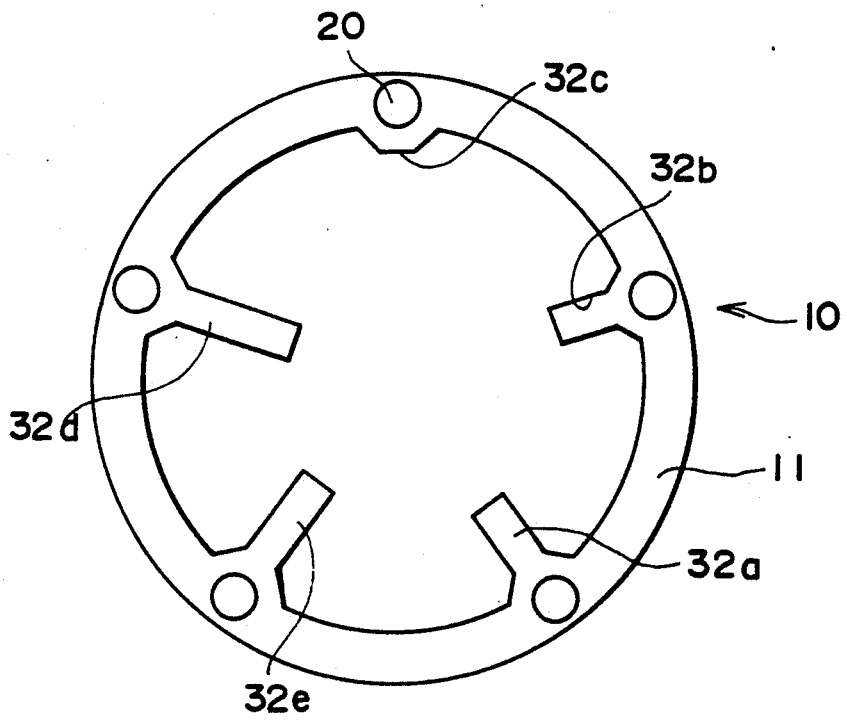
FIG. 4 is a front view of the coin throwing port restricting mechanism illustrated in FIG. 3.

In FIGS. 3 and 4, another embodiment of the present invention is shown. In this embodiment, the restriction arm member 13 comprises five different arms 32a through 32e. Five different arms 32a through 32e have five extending length l1 to l5, respectively, depending on the differences between one of five different coin diameters d1 to d5 and the throwing port length L.

Figure 5:
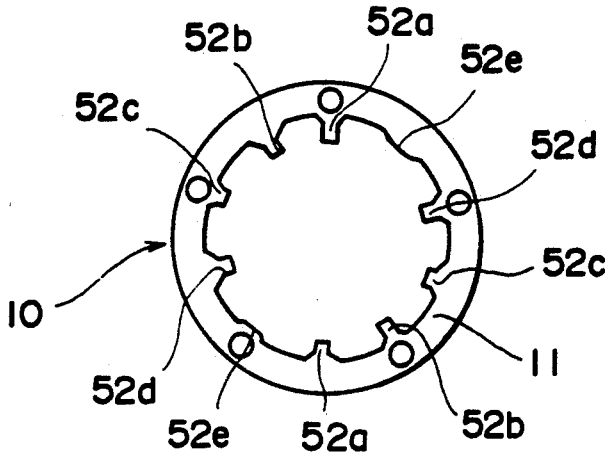
FIG. 5 is a front view of a coin throwing port restricting mechanism according to a third embodiment of the present invention.

A third embodiment of the present invention will be described with reference to FIG. 5. In this embodiment, five pairs of arms 52a through 52e are arranged at five different distances corresponding to the five coin diameters d1 to d5, respectively. In this event, the coin throwing port 4 is restricted from both sides of the longitudinal direction thereof.

Figure 6:
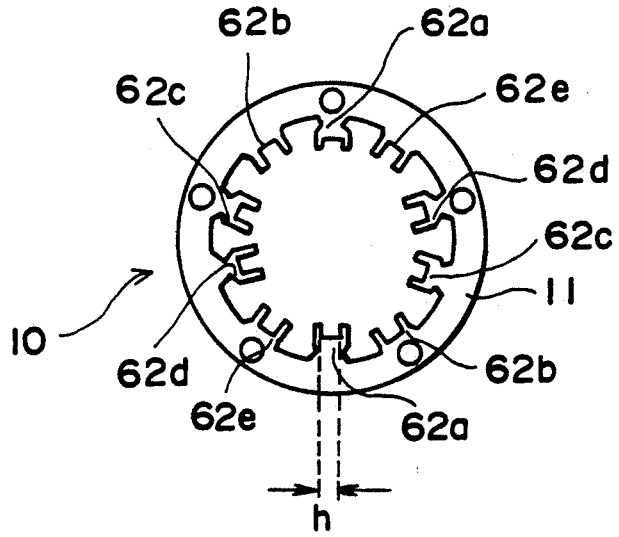
FIG. 6 is a front view of a coin throwing port restricting mechanism according to a fourth embodiment of the present invention.

A fourth embodiment of the present invention is shown in FIG. 6. The restriction arm member 13 comprises five pairs of arms 62a through 62e. The arms in each pair are opposed to each other at five distances corresponding to the five coin diameters d1 to d5, respectively. Each of the free ends of the five pairs of arms 62a through 62e is formed as a U-shape (in other words, a shape like a tuning folk). The free ends in each pair are opposed to each other at distances corresponding to the extending width h covering over the coin throwing port 4 in accordance with the differences between one of the five different thicknesses t1 to t5 and the throwing port width H. As a result, the thickness of the coin throwing port as well as the diameter thereof can also be restricted.

Figure 7:
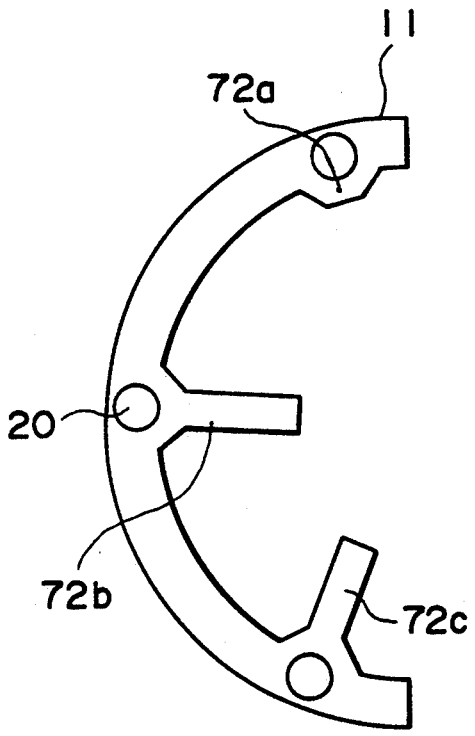
FIG. 7 is a front view of a coin throwing port restricting mechanism according to a fifth embodiment of the present invention.

Referring to FIG. 7, a fifth embodiment of the present invention will be described below. In this embodiment, a ring 11 which serves as a fixing member is formed having a shape like a part of a semicircle. The wing comprises three different arms 72a through 72c.

Next, with reference to FIGS. 3 and 10, holding portions 7, 7 extend from each of the pairs of the guide wall portions 6, 6, respectively, along peripheries of a semicircle. The coin throwing port restricting mechanism 10 engages with the holding portions 7, 7 while surrounding thereof. On the holding portions 7, 7, notches 9, 9 . . . are disposed to their respective arms 32, 32 Both of the notches 9, 9 . . . and the arms 32, 32 . . . are disposed equally apart from each other along the circumference of the ring 11. The width of each arm 32 is preferably smaller than the distance between a pair of guide wall portions 6, 6. When five arms 32, 32 . . . are disposed, the angle between adjacent arms 32, 32 with an axis at a center of the ring 11 is 72° each whereas, three arms provide an angle therebetween of 120°.

As a consequence, the arm 32 having a desired extending length is interposed between the guide wall portions 6, 6 to restrict the configuration of the coin throwing port 4. In addition, the positioning to the back surface 2 of the coin throwing port assembly 5 can be correctly made. Further, remaining arms 32 except for the one interposed between the guide wall portions 6, 6 are inserted into the notches 9. Accordingly, the coin throwing port restricting mechanism 10 can be positively inserted into and engaged with the holding portions 7, 7.

As mentioned above, an arm having a desired extending length or desired extending width can be selected only be means of rotating the coin throwing portion restriction mechanism 10. Accordingly, the configuration of the coin throwing port 4 can be readily restricted.

Each of bores 20 which passes through ring 11 is located at a position which corresponds to bores 21 which passes through the back surface 2 of the coin throwing port assembly 5. These bores 20 and 21 are used for securing the coin throwing port restricting mechanism 10 to the back surface 2 of the coin throwing port assembly 5 by means of screw or bolts (not shown). In addition, bores 8 are used for attaching the coin throwing port assembly 5 to the back surface 2 of the vending machine or the like.

As described above, the coin throwing port restricting mechanism according to the present invention 10 comprises a ring 11 and an arm 12. The ring 11 which serves as a fixing member surrounds the coin throwing port 4. The arm 12 extends from the inner periphery of the ring 11 to the center thereof in a manner that it faces the front of coin throwing port 4. The extending length and the extending width of the arm 12 are selectable depending on the diameter and the thickness of the coin. Thus, the configuration of the coin throwing port 4 can be restricted without modifying the shape thereof. Accordingly, by disposing the present invention on the back surface 2 of the vending machine or other coin operated machines, it becomes possible to vary the length and the thickness of the coin throwing port by means of simply handling the coin throwing port 4 restricting mechanism 10. Thus, it also becomes possible to manufacture such a coin operated device with lower costs.

While particular embodiments of the present invention have been illustrated and described above, it will be readily understood by those skilled in the art that the present invention can be varied and modified without departing from the scope and spirit of the appended claims. For example, the coin throwing port restricting mechanism 10 in the above mentioned embodiments has been described as the one disposed to the back surface 2 of the coin throwing port assembly 5. However, a pair of guide wall portions 6, 6 and holding portions 7, 7 may not be used to allow free rotation of the coin throwing port restricting mechanism 10.

What is claimed is:

1. A coin throwing device having a coin throwing wall consisting of a front surface and a back surface opposed to said front surface, and a coin throwing port which is opened on said coin throwing wall and which has a predetermined throwing port longitudinal length and a predetermined throwing port width, wherein said device comprises:

a fixing member removably attached to said back surface and a restriction arm member extending from said fixing member facing front said coin throwing port, said restriction arm member is formed to partially cover said coin throwing port depending on the size of said coin in order to substantially restrict the configuration of said coin throwing port, and said device further comprises:

a guide member disposed on said back surface along the longitudinal direction of said coin throwing port, said guide member is for use in guiding said restriction arm member into said coin throwing port.

2. A coin throwing device as claimed in claim 1, wherein said guide member comprises a pair of guide wall portions, said guide wall portions are opposed to each other and are for use in guiding said restriction arm member interposed therebetween to said coin throwing port.

3. A coin throwing port restricting mechanism for use in a coin throwing device having a coin throwing wall consisting of a front surface and a back surface opposed to said front surface, and a coin throwing port which is opened on said coin throwing wall for receiving a coin and which has a predetermined throwing port length and a predetermined throwing port width, wherein said coin throwing port restricting mechanism comprises:

a fixing member removably attached to said back surface, and a restriction arm member extending from said fixing member facing front said coin throwing port, said restriction arm member comprising a plurality of arms each of which has one of a plurality of extending lengths for partially covering said coin throwing port according to the difference between one of a plurality of different coin diameters and said throwing port length to substantially restrict the throwing port length of said coin throwing port, said plurality of extending lengths being different for corresponding plurality of different coin diameters, respectively.

4. A coin throwing port restricting mechanism as claimed in claim 3, wherein said arms of said restriction arm member are paired and have one of said plurality of extending lengths, said arms in each pair being opposed to each other at a distance corresponding to the different diameters of said coins.

5. A coin throwing port restricting mechanism for use in a coin throwing device having a coin throwing wall consisting of a front surface and a back surface opposed to said front surface, and a coin throwing port which is opened on said coin throwing wall for receiving a coin and which has a predetermined throwing port length and predetermined throwing port width, wherein said coin throwing port restricting mechanism comprises:

a fixing member removably attached to said back surface, and a restriction arm member extending from said fixing member facing front said coin throwing port, said restriction arm member comprises a plurality of arms each of which has one of a plurality of extending widths for partially covering said coin throwing port according to the difference between one of a plurality of different coin thicknesses and said throwing port width, said plurality of extending widths being different for corresponding plurality of different coin thicknesses, respectively.

6. A coin throwing port restricting mechanism as claimed in claim 5, wherein said arms of said restriction arm member are paired, said arms in each pair are opposed to each other at a plurality of distances corresponding to the plurality of diameters of said coins, respectively, and each of which has an extending width for partially covering said coin throwing port, and each of said plural pairs of arms has said extending width, respectively.

7. A coin throwing port restricting mechanism as claimed in claim 6, wherein each of said plural pairs of arms has different extending width.

8. A coin throwing port restricting mechanism as claimed in any one of claims 7, 5 or 6, wherein each of said arms comprises a substantially U-shaped tip portion at a free end thereof, said tip portions being opposed to each other at a distance corresponding to said extending width.

* * * * *